US009087223B2

(12) United States Patent
Tualle et al.

(10) Patent No.: US 9,087,223 B2
(45) Date of Patent: Jul. 21, 2015

(54) ANALOG ELECTRONIC CIRCUIT FOR PROCESSING A LIGHT SIGNAL, AND CORRESPONDING PROCESSING SYSTEM AND METHOD

(75) Inventors: Jean-Michel Tualle, Antony (FR); Antoine Dupret, Orsay (FR); Marius Vasiliu, Igny (FR)

(73) Assignees: Centre National De La Rcherche Scientifique (C.N.R.S), Paris (FR); UNIVERSITE PARIS 13, Villetaneuse (FR); Universite Paris-Sud 11, Orsay (FR)

( * ) Notice: Subject to any disclaimer, the term of this patent is extended or adjusted under 35 U.S.C. 154(b) by 324 days.

(21) Appl. No.: 13/520,324

(22) PCT Filed: Apr. 1, 2011

(86) PCT No.: PCT/FR2011/050746

§ 371 (c)(1),
(2), (4) Date: Nov. 21, 2012

(87) PCT Pub. No.: WO2011/121258

PCT Pub. Date: Oct. 6, 2011

(65) Prior Publication Data

US 2013/0056622 A1 Mar. 7, 2013

(30) Foreign Application Priority Data

Apr. 2, 2010 (FR) ..... 10 52535

(51) Int. Cl.
*H01J 40/14* (2006.01)
*G06G 7/19* (2006.01)

(52) U.S. Cl.
CPC ..... *G06G 7/1928* (2013.01)

(58) Field of Classification Search
CPC ..... G06G 7/1928
USPC ..... 250/214 R
See application file for complete search history.

(56) References Cited

U.S. PATENT DOCUMENTS 6,307,622 B1 * 10/2001 Lewis ..... 356/4.01
2003/0107742 A1 * 6/2003 Tualle ..... 356/450
2003/0223053 A1 * 12/2003 Liu et al. ..... 356/5.1

OTHER PUBLICATIONS

R. Dominguez-Castro, S.Espejo, A.,Rodriguez-Vazquez, R. A. Carmona, P. Foldesy, A. Zarandy, P. Szolgay, T. Sziranyi, T. Roska: "A 0.8-um CMOS two-dimensional programmable mixed-signal focal-plane array processor with on-chip binary imaging and instructions storage", IEEE Journal of Solid-State Circuits, vol. 32, No. 7, Jul. 1997, pp. 1013-1025.

(Continued)

*Primary Examiner* — Thanh Luu
(74) *Attorney, Agent, or Firm* — McDermott Will & Emery LLP

(57) ABSTRACT

This analog electronic circuit (2) for processing a light signal (4), of the type comprising:

a photodetector (6) adapted for producing an electric signal (8) from the light signal (4);

a multiplier (12) adapted for multiplying the electric signal (8) with a reference signal (14) for obtaining a multiplied signal (16); and an integrator (18) adapted for integrating the multiplied signal (16) over at least one time interval, in order to obtain one integrated signal, is characterized in that it further comprises:

an analog memory (24) adapted for storing the integrated signal in memory; and a computing unit adapted for estimating a time correlation of the light signal (4) from the integrated signal stored in memory.

11 Claims, 14 Drawing Sheets

(56) References Cited

OTHER PUBLICATIONS

G. Han, E. Sanchez-Sinencio: "CMOS transconductance multipliers: A tutorial", IEEE Transactions on Circuits and Systems II: Express Briefs, IEEE Service Center, New York, NY, US, X,P vol. 45, No. 12, Dec. 1998, pp. 1550-1563.

J.-M. Tualle, A. Dupret, M.Vasiliu: "Ultra-compact sensor for diffuse correlation spectroscopy", Electronics Letters, vol. 46, No. 12, Jun. 10, 2010, pp. 819-820.

An International Search Report, mailed on Jun. 22, 2011, which issued during the prosecution of PCT/FR2011/050746, which corresponds to this present application.

* cited by examiner

ANALOG ELECTRONIC CIRCUIT FOR PROCESSING A LIGHT SIGNAL, AND CORRESPONDING PROCESSING SYSTEM AND METHOD

CROSS REFERENCE TO RELATED APPLICATIONS

This application is a U.S. National Phase application under 35 U.S.C. §371 of International Application No. PCT/FR2011/050746, filed on Apr. 1, 2011 which claims priority to FR 10 52535 filed Apr. 2, 2010. All of these applications are herein incorporated by reference.

The present invention relates to an analog electronic circuit for processing a light signal, comprising:

- a photodetector adapted for producing an electric signal from the light signal;
- a multiplier adapted for multiplying the electric signal with a reference signal in order to obtain a multiplied signal; and
- an integrator adapted for integrating the multiplied signal over at least one time interval in order to obtain at least one integrated signal.

It also relates to a corresponding system and method for processing a light signal as well as to an electronic structure for demodulating an electric signal. The invention particularly applies to the field of optical and acousto-optical imaging.

Patent application WO 01/88507 A1 in the name of the Applicant discloses a device for analyzing a scattering sample by time-resolved measurement of the scattered light in this sample, comprising a circuit of the aforementioned type. The device described in this patent application uses modulation of light beams and allows measurements of time correlation functions of the scattered light for a transit time notably determined in many applications for medical diagnosis.

However, the device disclosed in the aforementioned patent application, although giving the possibility of obtaining promising results, does not allow in vivo experiments to be carried out in the field of medical diagnosis.

For this, it is necessary to improve the signal-to-noise ratio of this device. The signal-to-noise ratio is all the more significant since the number of measurements conducted by the device is large.

In order to have a large number of measurements, it is necessary to use a long acquisition time, or else simultaneously conduct a large number of measurements over a same time interval, by reproducing this measurement device a large number of times.

It is therefore necessary to miniaturize the whole of the device in order to increase the number of measurements on a given detection surface area.

The object of the invention is to solve this problem.

More particularly, the invention is directed to proposing a technological solution for integrating the whole of the measurement device disclosed in the aforementioned application into a small size integrated circuit.

For this purpose, the object of the invention is an analog electronic circuit for processing a light signal, comprising:

- a photodetector adapted for producing an electric signal from the fight signal;
- a multiplier adapted for multiplying the electric signal with a reference signal in order to obtain a multiplied signal; and
- an integrator adapted for integrating the multiplied signal over at least one time interval, in order to obtain at least one integrated signal, the electronic circuit being characterized in that it further comprises:

- an analog memory adapted for storing the integrated signal in memory; and
- a computing unit adapted for estimating time correlation of the light signal from the integrated signal stored in memory.

According to other aspects of the invention, the analog electronic circuit for processing a light signal comprises one or more of the following features taken individually or according to all technically possible combinations:

- the memory comprises a plurality of data registers adapted for storing at least the integrated signal in memory and a reference register adapted for storing a reference voltage in memory,
- the computing unit comprises a differential input multiplier,
- it comprises an amplifier for the electric signal produced by the photodetector,
- the photodetector includes a photodiode,
- the photodetector includes a high-pass filter, and
- it is integrated in a pixel with a size of less than or equal to 42*44 μm.

The object of the invention is also an electronic structure for demodulating an electric signal, characterized in that it comprises:

- a voltage inverting amplifier receiving on its input the electric signal;
- an integrator, the input operating point of which corresponds to the input operating point of the voltage inverting amplifier, and
- first and second identical resistive devices, the conductances of which are voltage-controlled, the first resistive device connecting the output and the input of the voltage amplifier and the second resistive device connecting the output of the voltage inverting amplifier and the input of the integrator.

According to other aspects of the invention, the electronic demodulation structure comprises one or more of the following features taken individually or according to all the technically possible combinations:

- the electronic demodulation structure comprises a filtering capacitor connected to the output of the second resistive device, and
- the electronic demodulation structure comprises a filtering capacitor connected between the voltage inverting amplifier and the second resistive device.

According to a particular embodiment, the aforementioned electronic circuit is characterized in that the whole of the multiplier and of the integrator comprises an electric demodulation structure according to the invention.

The object of the invention is also a system for processing a light signal, characterized in that it comprises a plurality of electronic circuits according to the invention connected together in an integrated circuit and means for summing time correlations obtained at the output of all the electronic circuits of the system.

According to a particular embodiment, the system for processing a light signal is characterized in that it comprises means for selectively disconnecting each of the electronic circuits of the system.

The object of the invention is further a method for processing a light signal comprising:

- a step for producing an electric signal from the light signal;
- a step for multiplying the electric signal with a reference signal in order to obtain a multiplied signal; and a step for integrating the multiplied signal over at least one time interval, in order to obtain at least one integrated signal, the method being characterized in that it further comprises:

a step for storing in memory the integrated signal in an analog memory; and a step for estimating time correlation of the light signal from the integrated signal stored in memory.

According to a particular embodiment of the invention, the method for processing a light signal is characterized in that the reference signal is a signal with a constant sign.

Thus, with the invention, it is possible to miniaturize the device described in patent application WO 01/88507 A1 by integrating it into a space of the order of 42×44 μm representing a detection pixel. With the invention, it is then possible to integrate a large number of these pixels on an integrated circuit and to simultaneously use a large number of measurement devices so as to significantly increase the signal-to-noise ratio, which allows use of the device in medical diagnosis applications so as to be able to obtain a signal on biological tissues and in acousto-optical imaging by allowing optical contrast measurements to be carried out while benefiting from the very high spatial resolution of acoustic imaging techniques with ultrasonic waves.

Embodiments of the invention will now be described more specifically, but not in a limiting way with regard to the appended drawings wherein:

FIG. 1 is a block diagram illustrating the structure of a circuit for processing a light signal according to the invention, FIG. 2 is a block diagram illustrating an exemplary embodiment of a high pass filter according to the invention, FIG. 3 is a block diagram illustrating an alternative of the structure of FIG. 2, FIG. 4 is a block diagram illustrating a first embodiment of a photodetector according to the invention, FIG. 5 is a block diagram illustrating a second embodiment of a photodetector according to the invention, FIG. 6 is a block diagram illustrating a third embodiment of a photodetector according to the invention.

FIG. 7 is a block diagram illustrating a fourth embodiment of a photodetector according to the invention, FIG. 8 is a block diagram illustrating a fifth embodiment of a photodetector according to the invention, FIG. 9 is a block diagram illustrating an embodiment of an amplification structure according to the invention, FIG. 10 is a block diagram illustrating an exemplary embodiment of an inverting amplifier with the structure of FIG. 9, FIG. 11 is a block diagram illustrating a demodulation structure comprising a multiplier and an integrator according to the invention, FIG. 12 is a block diagram illustrating a first embodiment of the resistive devices of the structure of FIG. 11, FIG. 13 is a block diagram illustrating a second embodiment of the resistive devices of the structure of FIG. 11, FIG. 14 is a block diagram illustrating a third embodiment of the resistive devices of the structure of FIG. 11, FIGS. 15 and 16 are block diagrams illustrating the structure of means for generating the control voltages in FIG. 11, FIG. 17 is a block diagram illustrating a structure of a reference register according to the invention, FIG. 18 is a block diagram illustrating the structure of a data register according to the invention, FIG. 19 is a block diagram illustrating the differential input multiplier, FIG. 20 is a block diagram illustrating the structure of a system for processing a light signal according to the invention, FIG. 21 is a block diagram illustrating the structure of a current inverter according to the invention, FIG. 22 is a block diagram illustrating an exemplary embodiment of the structure of FIG. 21, FIG. 23 is a block diagram illustrating the structure of reading means at the output of the system according to the invention, FIG. 24 is a block diagram illustrating an exemplary architecture of a system for processing a light signal according to the invention, FIG. 25 is a similar view to that of FIG. 11 according to a second embodiment of the multiplier, and FIG. 26 is a similar view to that of FIG. 11 according to a third embodiment of the multiplier.

FIG. 1 illustrates a structure of an analog electronic circuit 2 for processing a light signal 4 according to the invention.

The circuit 2 comprises a photodetector 6 adapted for producing an electric signal 8 from the light signal 4.

According to a particular embodiment of the invention, the circuit 2 includes an amplifier 10 for amplifying the electric signal 8.

The circuit 2 further comprises a multiplier 12 adapted in order to multiply the electric signal 8, optionally amplified by the amplifier 10, with a reference signal f(t) 14 with constant sign in order to obtain a multiplied signal 16.

The multiplier 12 is connected to an integrator 18 adapted for integrating the multiplied signal 16 over at least one time interval in order to obtain at least one integrated signal.

In FIG. 1, two integrated signals 20 and 22 are illustrated at the output of the integrator 18. The signal 20 is a reference voltage obtained by a particular selection of the integration time interval and of the reference signal 14.

The signal 22 is stored in a memory 24 comprising a plurality of data registers Reg_1 26, Reg_2 28, . . . , Reg_N 30 and a reference register RegRef 32 adapted for storing the reference voltage 20 in memory. As an example, the integrated signal 22 is stored in the data register Reg_2 28.

The analog memory 24 allows one random access with writing and two random accesses when reading so as to be able to simultaneously read the contents of two different or identical data registers.

A multiplier 34 with a differential input is adapted for multiplying the contents of two different or identical registers of the memory 24, for example the contents of registers 28 and 30.

The result 36 of the multiplication carried out by the multiplier with a differential input 34 represents the time correlation of the measurements recorded over two different or identical integration time intervals which allows estimation of the time correlation of the light signal 4. The contents of the reference register Reg Ref 32 determine the reference value of the differential input of the differential input multiplier 34, the result of the multiplication being in this case:

Result=Co+K (Reg_i−RegRef)×(Reg_j−RegRef), Co and K being two constants depending on the structure of the differential input multiplier 34 and Co may be zero.

According to an embodiment of the invention, the photodetector 6 is a simple photodiode.

According to another preferred embodiment of the invention, the photodetector 6 comprises a photodiode associated with a high-pass filter allowing filtering of the low frequency components of the detected signal, notably the DC component, so as to only transmit the high frequency components which contain the relevant information and thus allow a larger dynamic range.

FIG. 2 shows an exemplary embodiment of such a high-pass filter associated with a photodiode 40. This high-pass filter comprises a voltage-controlled current source 42 which is used for compensating for the low frequencies of the photocurrent generated by the photodiode 40.

The high-pass filter further comprises optionally a voltage inverting amplifier 44 with an adjustable band pass, the input of which is connected to a node N common to the photodiode 40 and to the voltage-controlled current source 42.

The high-pass filter also comprises a capacitor 46 inserted between the node N and the output towards the multiplier 12.

High-pass filtering is essentially carried out by the capacitor 46, the band pass of this filter being approximately equal to $G/(2\pi R_d C)$, G being the absolute value gain of the amplifier 44, $R_d$ the dynamic transimpedance of the voltage-controlled current source 42 and C the capacitance of the capacitor 46.

The capacitor 46 also allows the operating point of the amplifier 44 to be isolated. which is also the bias voltage of the photodiode 40, from the operating point of the multiplier 12. By this circuit, it is moreover possible to reduce the cut-off frequency of the high-pass filter, by reducing the band pass of the amplifier 44 which is adjustable.

It may be advantageous to select the capacitance C of the capacitor 46 so as to be greater than the input capacitance of the multiplier 12, in order not to excessively reduce the useful signal.

The assembly formed by the photodiode 40 and the capacitor 46 may advantageously be integrated onto a MOS technology circuit by using a varicap 48, an equivalent diagram of which is given in FIG. 3. Such an assembly is applied with CMOS technology for example.

FIG. 4 shows a first exemplary embodiment of the photodetector 6 comprising the varicap 48 (formed by the photodiode 40 and the capacitor 46) and a transistor 50 (of the NMOS type for example) making up the voltage-controlled current source 42.

The transistor 50 operates in a saturated mode and behaves like a current source controlled by the potential of the node N. In this circuit, the cut-off frequency of the high pass filter only depends on the bias current of the photodiode 40, i.e. on the incident light flux, and cannot be adjusted by any other means. Further, this cut-off frequency is not very high.

FIG. 5 illustrates a second exemplary embodiment of the photodetector 6 comprising in addition to the varicap 48 and to the transistor 50 making up the voltage-controlled current source, a differential amplifier 52 consisting of the transistors M1.3 to M1.7, which is a possible embodiment for the amplifier 44. The operating mode of this differential amplifier 52 is determined by a potential VPOL, which determines the bias of the photodiode 40, as well as by a potential vIPOL_AOFILTR, which sets the current in the differential amplifier 52. It is thus possible to limit the band pass of this differential amplifier 52 by acting on the latter potential. The higher vIPOL_AOFILTR, the higher is the band pass of the amplifier 44 and the higher is the cut-off frequency of the high pass filter.

A transistor M1.2 54 may advantageously be inserted between the gate of the transistor 50 and the output of the amplifier 44. Operating in a linear mode, the transistor 54 behaves like a resistive device, the conductance of which is adjusted by the voltage VCONTR. With the gate capacitance of the transistor 50, this resistance carries out additional high pass filtering and may notably be used for limiting certain overvoltage phenomena.

FIG. 6 illustrates a third exemplary embodiment of the photodetector 6 comprising in addition to the varicap 48 and to the transistor 50 forming the voltage-controlled current source 42, an inverting amplifier 56, according to this exemplary embodiment, consisting of two transistors 58 and 60. The operating mode of this amplifier 56 is determined by the two potentials VM1.1 and VP1.1, which set the bias potential of the photodiode 40 at the node N, as well as the current which passes through the inverting amplifier 56. It is thus possible to limit the band pass of this amplifier 56 by acting on this current. The lower it is, the narrower is the band pass of the amplifier 56 and the lower is the cut-off frequency of the high pass filter.

Like in the exemplary embodiment of FIG. 5, a transistor 54 may advantageously be inserted between the gate of the transistor 50 and the output of the inverting amplifier 56 operating in a linear mode. The transistor 54 behaves like a resistive device, the conductance of which is adjusted by the voltage VCONTR. With the gate capacitance of the transistor 54, this resistance carries out additional filtering and may notably be used for limiting certain overvoltage phenomena.

FIG. 7 illustrates an alternative close to the one of FIG. 4, but in which the transistor 50 rather operates in a linear mode, behaving like a resistive device, the conductance of which is controlled by the voltage VCOM. This solution is however less advantageous since it is very noisy.

Figure 8:
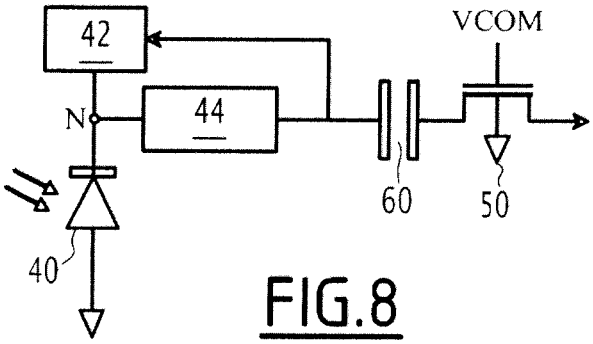

In FIG. 8, the signal consists of the voltage for controlling the current source 42, which is then converted into a current by the transistor 50, which operates in a linear mode and behaves like a resistive device, the conductance of which is controlled by the voltage VCOM. A capacitance 60, which may advantageously be a varicap, gives the possibility of achieving the high pass filtering function. The latter solution gives the possibility of easily having a high transimpedance, but the value of which depends on the incident light flux and cannot be adjusted by any other means.

Figure 9:
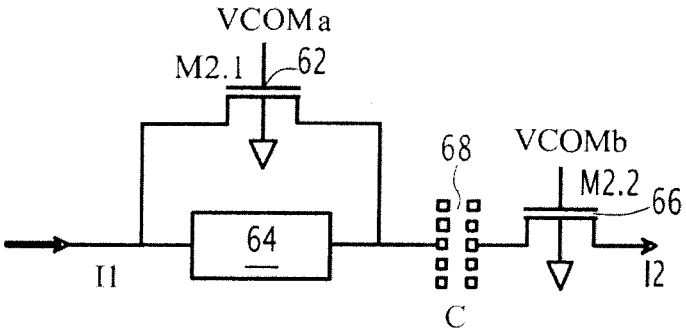

FIG. 9 illustrates an exemplary embodiment of the amplifier 10 which is optionally inserted into the circuit according to the invention.

The amplifier 10 comprises a transistor M2.1 62, placed between the output and the input of an inverting amplifier 64 controlled by a voltage VCOMa. The transistor 62 gives the possibility of converting an inflowing current I1 into a voltage, which will then be reconverted into a current I2 by a transistor M2.2 66 placed at the output of the amplifier, in a way similar to the diagram of FIG. 8. A capacitance 68 is also advantageously placed in series with the transistor M2.2 66, in order to carry out an additional high pass filtering function, and isolate the operating point of the inverting amplifier 64 from the remainder of the circuit.

Figure 6:
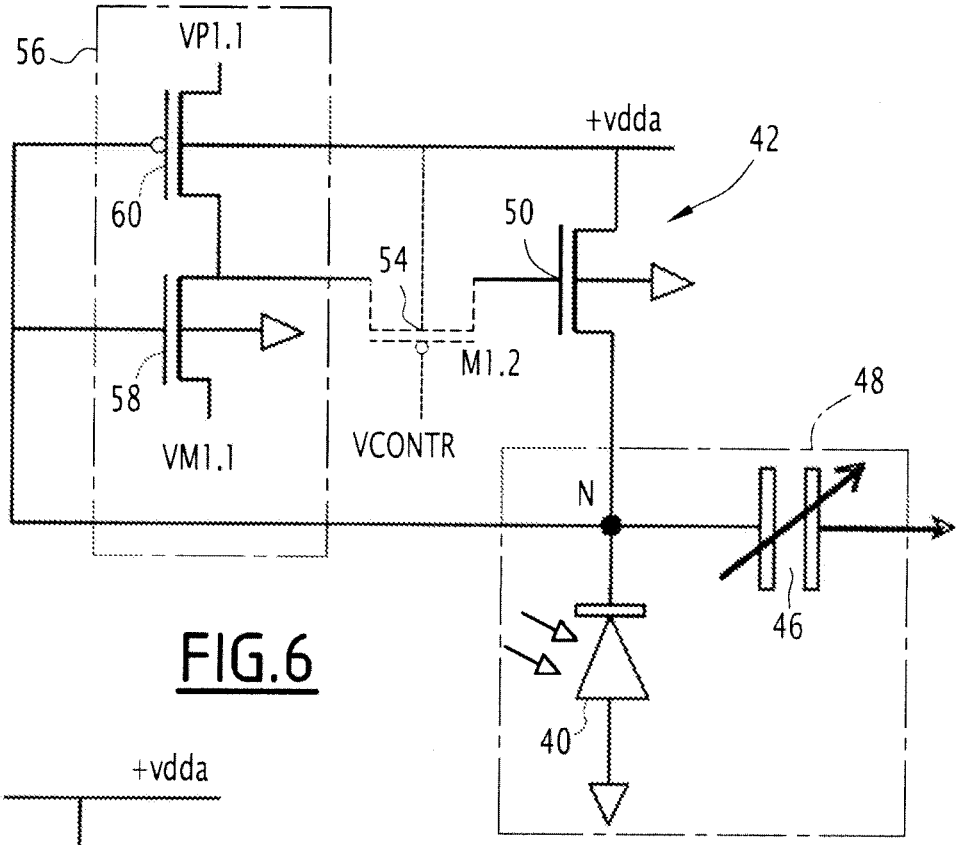
Figure 7:
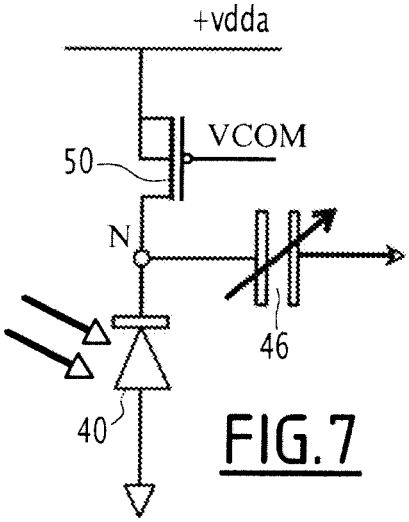
FIGS. 7 and 8 show alternatives for the photodetector 6.

The inverting amplifier 64 for example consists of two transistors, in a similar way to the example of FIG. 6 for the amplifier 56.

Figure 10:
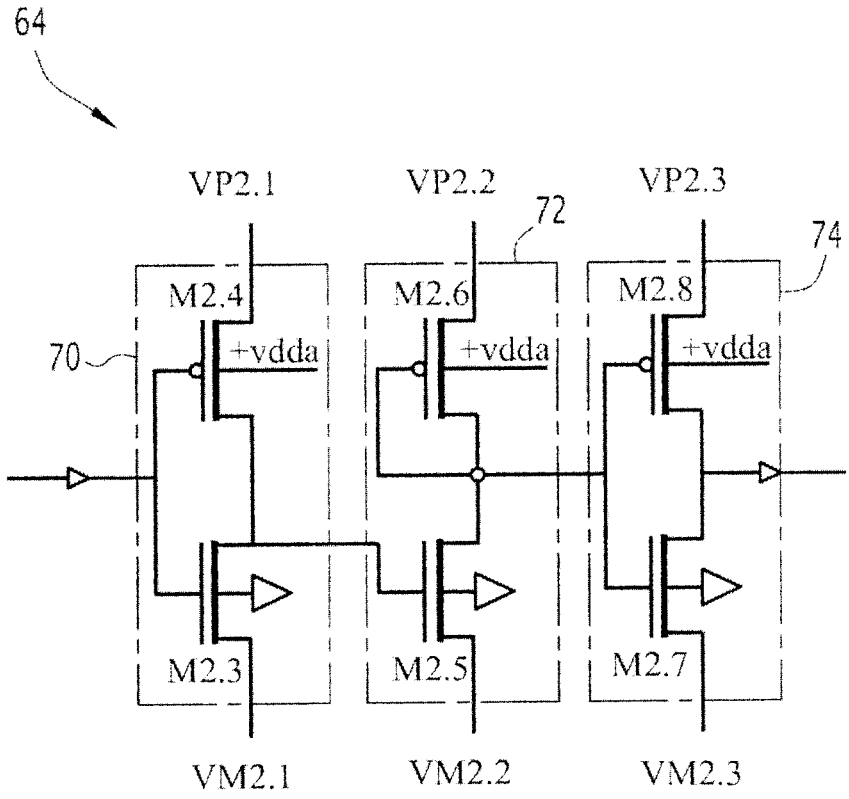

FIG. 10 illustrates an alternative embodiment of the inverting amplifier 64 with which it is possible to have a large value for the Gain×Bandpass product. According to the alternative embodiment of FIG. 10, the inverting amplifier 64 consists of the transistors M2.3 to M2.8. The transistors M2.3 and M2.4 form a first inverting amplifier 70, on the model of the example of FIG. 6. This first amplification stage 70 is biased between the potentials VM2.1 and VP2 1. The transistors M2.5 and M2.6 form a second inverting amplifier 72 of low gain, biased between the potentials VM2.2 and VP2.2 while the transistors M2.7 and M2.8 form a third inverting amplifier 74 similar to the first, biased between the potentials VM2.3 and VP2.3. These three amplifiers 70, 72 and 74 are mounted in series. It is important that one of the three amplifiers 70, 72 and 74 be of low gain, since the succession of three identical amplifiers leads to unstable feedback. In the example of FIG. 10, it is the second amplifier 72 which is advantageously selected to have a low gain. However, it is possible to select another order of succession for these amplifiers.

It is advantageous to properly bias the first amplifier 70, which is responsible for the essential part of the electronic noise, in order to limit said electronic noise. The VP2.1-VM2.1 difference is therefore set to be high, while ensuring that reasonable power consumption is retained at this level. Moreover, it is advantageous to use different power supply lines for the different amplifiers 70, 72 and 74 of the circuit, so as to avoid parasitic couplings between the different amplifiers.

Figure 11:
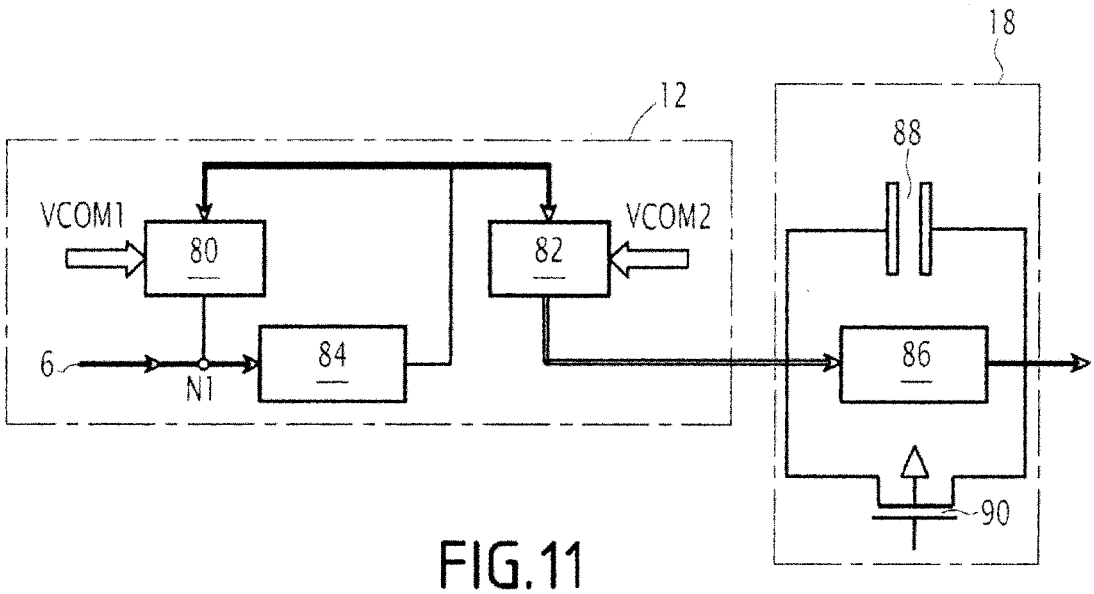

FIG. 11 illustrates the structure of the multiplier 12 and of the integrator 18. This demodulation stage consisting of the multiplier 12 and the integrator 18 comprises two identical resistive devices 80 and 82, the conductances of which are voltage-controlled, a first voltage-inverting amplifier 84, a second voltage-inverting amplifier 86, the input operating point of which is approximately identical to that of the amplifier 84. Both of these inverting amplifiers 84 and 86, as an example, each consist of two transistors, in a way similar to the example of FIG. 6 for the amplifier 56. However a more performing structure such as for example that of FIG. 10 may also be used notably when the amplifier 10 is not included in the circuit according to the invention. In order to ensure that the input operating points of both amplifiers 84 and 86 are identical, it is possible to use two identical structures biased in the same way. However, it may be advantageous to use a more performing structure for the amplifier 84, such as that of FIG. 10, and use a structure with two transistors for the amplifier 86. In this case, it is sufficient that the amplifier 86 be identical with the first stage of the amplifier 84 and be biased in the same way.

The input of the amplifier 84 is connected to the node N1 common to the output of the photodetector 6 and to one of the terminals of the resistive device 80.

Of course, in the case of a circuit including the amplifier 10, the input of the amplifier 84 is connected to the node common to the output of the amplifier 10 and to one of the terminals of the resistive device 80.

The output of the amplifier 84 is connected to the other terminal of the resistive device 80 and to the resistive device 82, the other terminal of the resistive device 82 being connected to the input of the amplifier 86. The control voltage for voltages) VCOM1 of the resistive device 80 is (are) set, thereby setting the value of the conductance of this resistive device 80. The output voltage of the amplifier 84 is automatically adjusted by the feedback so that the current which flows through the resistive device 80 compensates for the high frequency components of the photocurrent from the photodetector 6.

By design, the operating point of the amplifier 84, i.e. the voltage at its input, should be approximately identical to that of the amplifier 86, i.e. to the voltage at its input. In this case, if, by adjusting the control voltage(s) VCOM2 of the resistive device 82 so that its conductance is the product of that of the resistive device 80 by a number f, then the current flowing through the resistive device 82 will approximately be equal to the product of the current flowing through the resistive device 80 with f. The only constraint is that the number f is positive.

By suitably varying the control voltage(s) VCOM2, it is thereby possible to access the product of the photocurrent with a positive arbitrary function $f(t)$. The fact that the function $f(t)$ is positive is not a limitation; it is sufficient to select:

$$f(t)=\mathrm{Ref}(t)+f_0(t)$$

$f_0(t)$ is a positive function providing guarantee of the positivity of $f(t)$. $f_0(t)$ should be selected so that it only contains low frequencies, and the contribution of the product of $f_0(t)$ with the high frequency components of the photocurrent is negligible after the integrator 18 acting as a filter for high frequencies.

The integrator 18 is a standard structure, consisting of the amplifier 86 and of a capacitor 88 placed between the input and the output of the amplifier 86. The current flowing through the resistor 82 is simply integrated in the capacitor 88. A transistor 90, also placed between the input and the output of the amplifier 86, allows resetting of the integrator 18. The output of the integrator 18 which is also the output of the amplifier 86, is connected to the memory 24 of FIG. 1.

Figure 12:
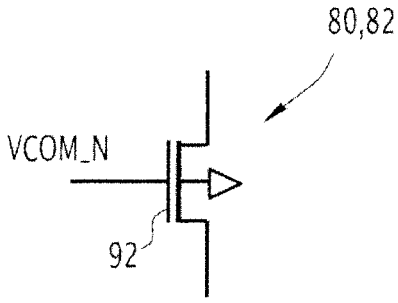
Figure 13:
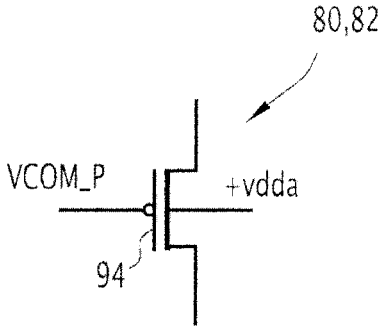
Figure 14:
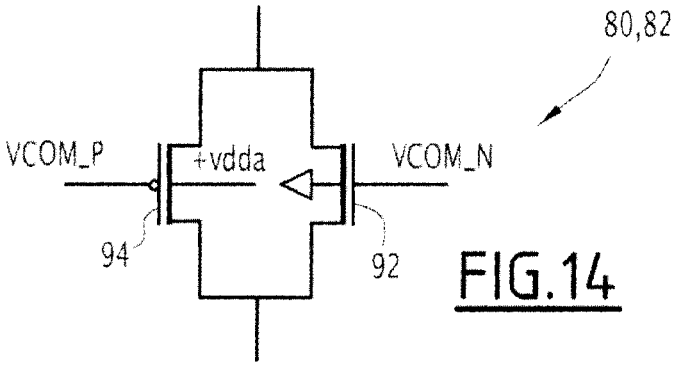

FIGS. 12, 13 and 14 illustrate various possibilities for the resistive devices 80 and 82. Each of these resistors 80, 82 may either consist in an NMOS transistor 92 controlled by a voltage VCOM_N (FIG. 12) or else in a PMOS transistor 94 controlled by a voltage VCOM_P (FIG. 13), or else in both of these transistors 92 and 94 in parallel (FIG. 14). These transistors will behave like resistors when they operate in a linear mode. Now, the structure according to the invention, consisting of two identical structures, allows proper operation even if one leaves this linear mode. In this sense, the structure of FIG. 14, which does not show any saturation, may advantageously be used for increasing the detection dynamic range of the system. Further, in a low inversion mode, the resistance of a transistor in the linear mode depends on its gate voltage exponentially, a voltage added to the control voltage corresponding to a multiplying factor for this resistance and an offset error corresponding to a simple multiplying factor.

Figure 15:
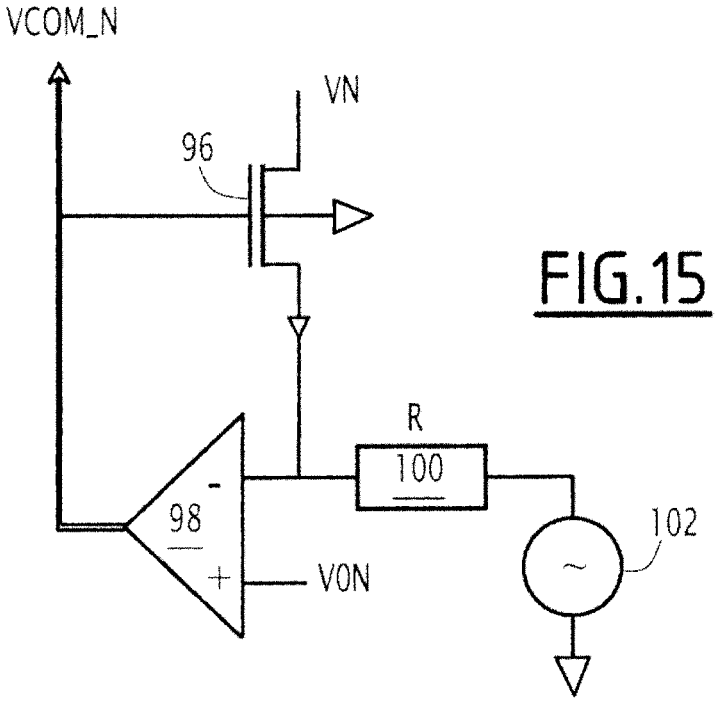
Figure 16:
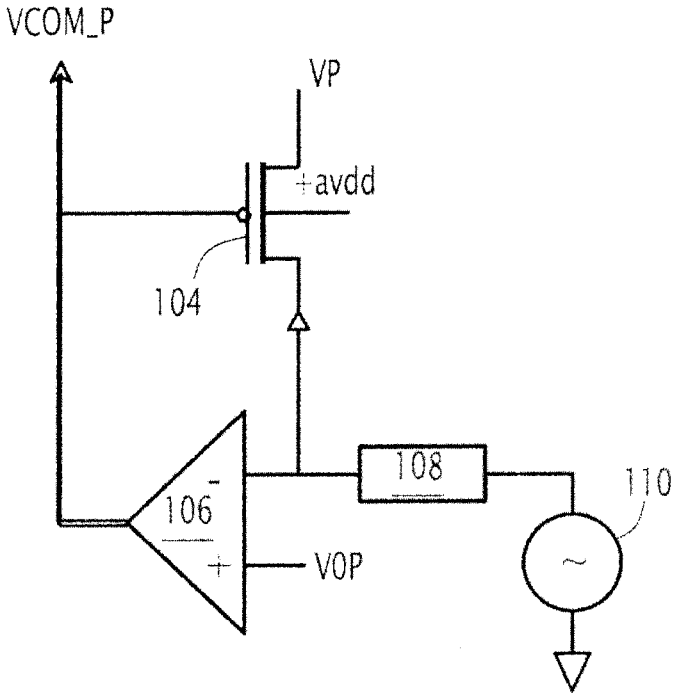

FIGS. 15 and 16 show means according to the invention for generating signals for controlling the resistors 80 and 82.

FIG. 15 shows a means for generating the VCOM_N signal for controlling the NMOS transistor 92 of FIG. 12 (the same signal may control the NMOS transistor 92 of FIG. 14). This application circuit consists of a transistor 96 identical with the NMOS transistor 92 making up the resistive device 82 or optionally a much wider transistor (a transistor n times wider corresponding to a juxtaposition of n identical transistors) and of an operational amplifier 98 as well as a resistance 100.

The non-inverting terminal of the operational amplifier 98 is set to a potential VON. The drain of the NMOS transistor 96 is connected to a fixed potential VN, while its source is connected to the inverting input of the operational amplifier 98 and to one of the terminals of the resistor 100. The other terminal of the resistor 100 is connected to a programmable voltage source 102. The output of the operational amplifier 98 is connected to the gate of the NMOS transistor 96 and defines the potential VCOM_N. The thereby defined VCOM_N signal sets the resistance of the NMOS transistor 96 so that, under the set potential difference VN-VON, the current flowing through the latter is identical with the current flowing through the resistor 100, which is itself determined by the programmable voltage source 102. If the voltage VON is identical with the operating point at the input of the amplifier 86, then the NMOS transistor 92 forming the resistive device 82 will have the same resistance (or a resistance multiplied by a factor n if the transistor of FIG. 15 is n times wider than the one which makes up the resistive device 82). Otherwise, in the low inversion mode, an offset error corresponds to a simple multiplying factor. Finally, in the low inversion mode, the NMOS transistor 96 should not necessarily operate in a linear mode, but it is possible to assume that VN equals +avdd.

Also, FIG. 16 shows a means for generating the VCOM_P signal for controlling the PMOS transistor 94 of FIG. 13 (the same signal may control the PMOS transistor 94 of FIG. 14). This application circuit consists of a transistor 104 identical with the PMOS transistor 94 making up the resistive device 82 or optionally much wider (a transistor which is n times wider corresponds to a juxtaposition of n identical transistors) and of an operational amplifier 106 as well as a resistor 108.

The non-inverting terminal of the operational amplifier 106 is set to a potential VOP. The drain of the PMOS transistor 104 is connected to a set potential VP, while the source is connected to the inverting input of the operational amplifier 106 and to one of the terminals of the resistor 108. The other terminal of the resistor 108 is connected to a programmable voltage source 110. The output of the operational amplifier 106 is connected to the gate of the PMOS transistor 104, and defines the potential VCOM_P. The thereby defined V_COMP signal sets the resistance of the PMOS transistor 104 so that, under the set potential difference V0P−VP, the current flowing through the latter is identical with the current flowing through the resistor 108, which is itself determined by the programmable voltage source 110. If the voltage V0P is identical with the operating point at the input of the amplifier 86, then the PMOS transistor 94 making up the resistive device 82 will have the same resistance (or a resistance multiplied by a factor n if the transistor of FIG. 16 is n times wider than the one which makes up the resistive device 82). Otherwise, in the low inversion mode, an offset error corresponds to a simple multiplying factor. Finally, in the low inversion mode, the PMOS transistor 104 should not necessarily operate in a linear mode, it is possible to assume that VP equals 0.

Figure 17:
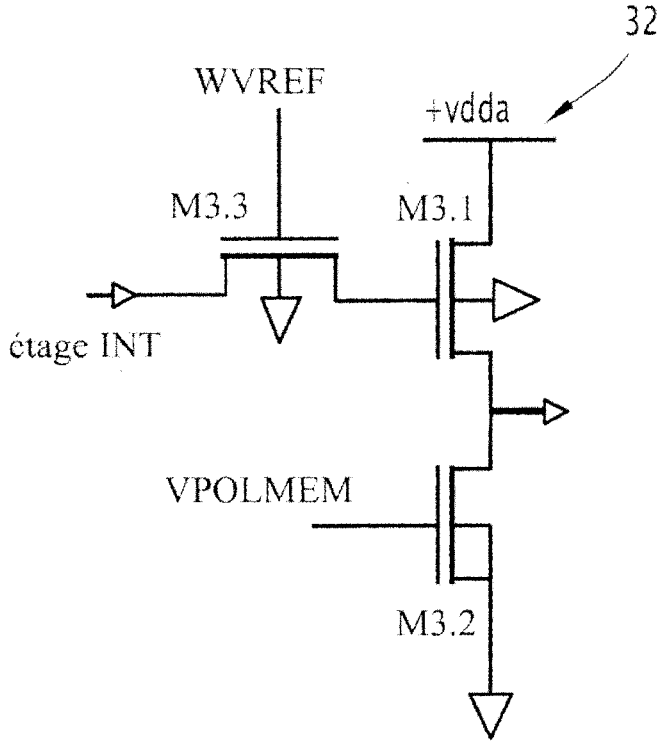

FIG. 17 illustrates an embodiment of the reference register 32 of the analog memory 24. This reference register 32 is regularly refreshed by recording as an example a measurement result taken with a reference signal 14 $f(t)=f_0(t)$ from the multiplier 12 level.

According to the embodiment of FIG. 17, the reference register 32 essentially comprises a follower circuit, consisting of transistors M3.1 and M3.2. A transistor M3.3 is also provided for operating in a switch mode. According to the control signal WVREF, the voltage to be stored in memory may thus be recorded on the gate of the transistor M3.1 when M3.3 is closed, and then stored in memory when 3.3 is open. The output VREF of the follower is, to within an offset, a copy of the gate voltage stored in memory. It is directly connected to the differential inputs of the multiplier with differential input 34.

Figure 18:
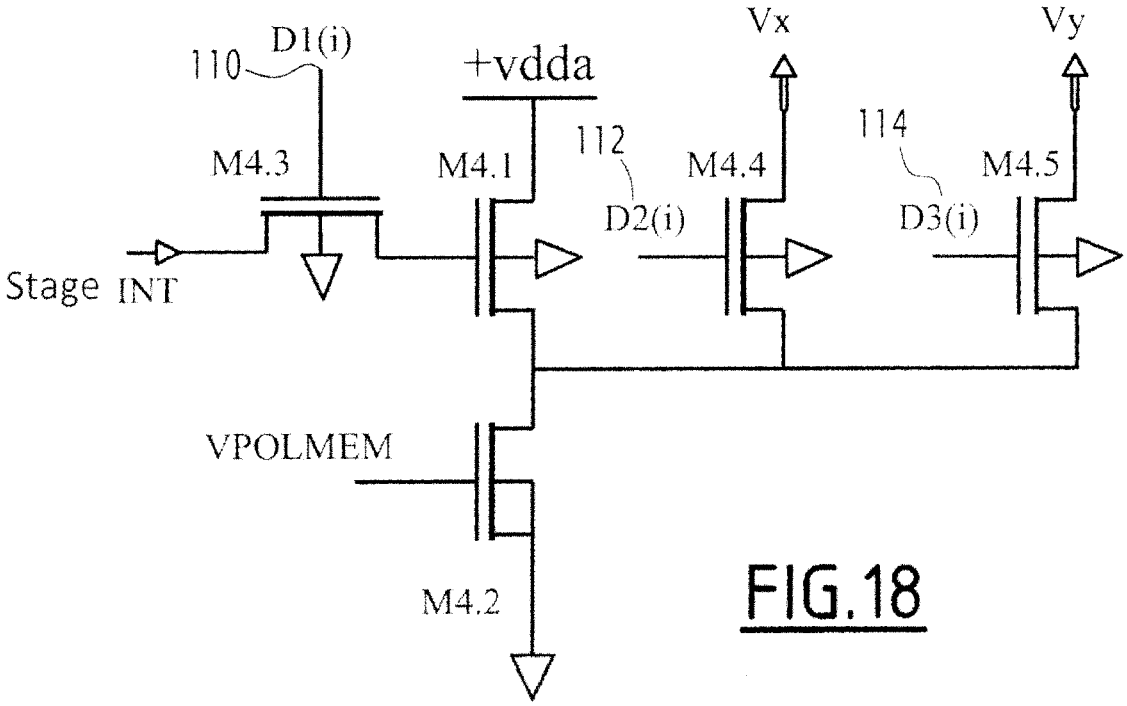

The data registers Reg_1 26, Reg_2 28 . . . , Reg_N 30 have random access in writing and dual random access in reading. Their implementation, an example of which is shown in FIG. 18 is identical with that of the register RegRef 32, except that the recording operation is controlled by a signal D1(*i*)(110, and that the output is isolated from the inputs Vx and Vy of the differential input multiplier 34 by two transistors M4.4 and M4.5, controlled by two signals D2(*i*) 112 and D3(*i*) 114. It is thus possible, by using D2(*i*) 112 and D3(*i*) 114 to carry out the multiplication of any pair of registers of the memory 24.

According to an alternative, in order to simplify the wiring of the memory 24 and to limit the control buses, it may be advantageous to connected the reading and writing selection according to for example: D1(*i*)=(WVALUE) AND D2(*i*); in this case, the designation of the register in writing is identical with that of one of the reading routes and writing is then conditioned to a control signal WVALUE. Also still for reducing the size of the control buses, it will advantageously be possible to write D2(*i*)=A2(*i*) AND B2(*i*), as well as D3(*i*) =A3(*i*) AND B3(*i*). Each of these AND operations may be achieved with a simple transistor operating in a switch mode, provided that it is ensured that the potentials of the drain and of the source of said transistor are reset before opening the equivalent switch.

Figure 19:
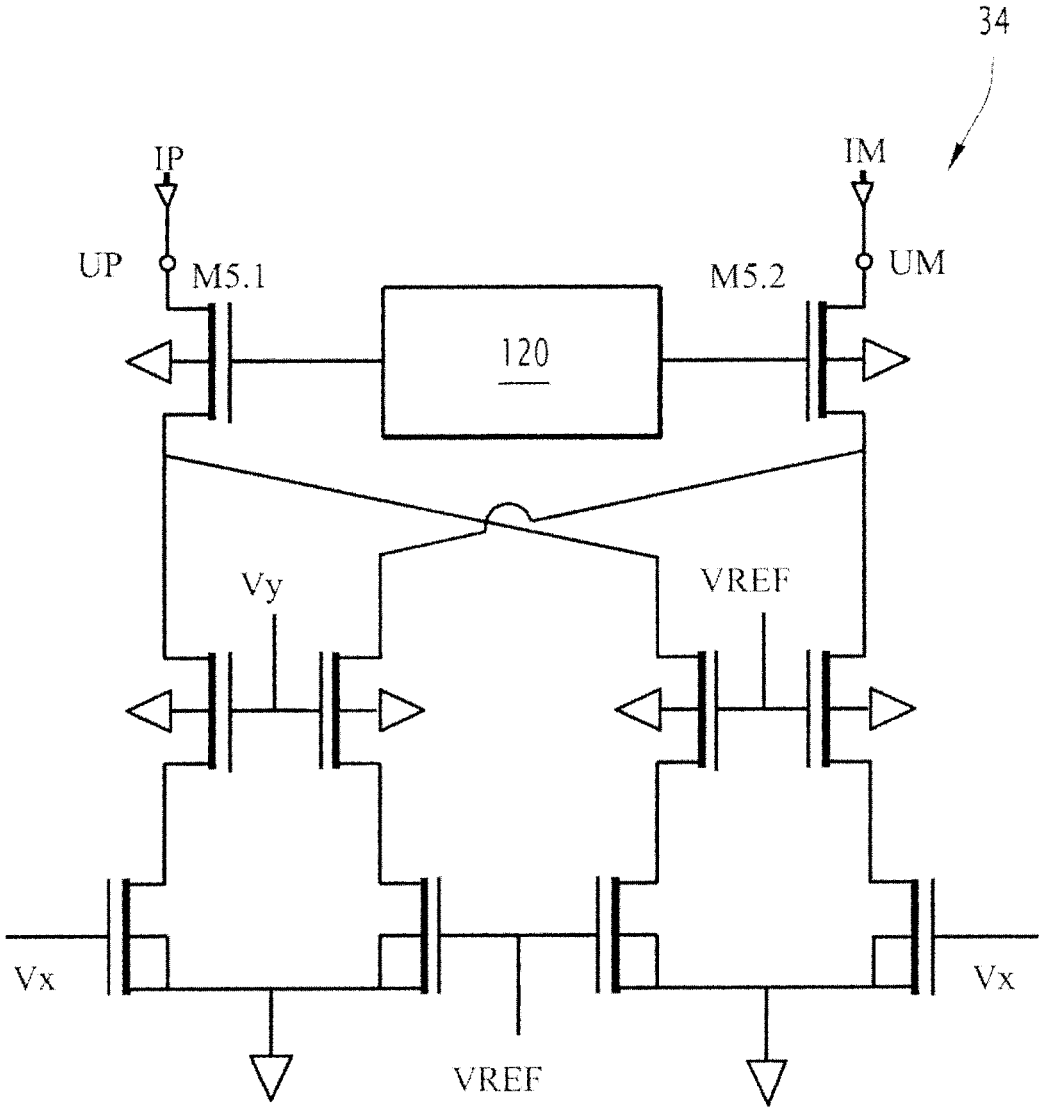

The differential input multiplier 34 is a multiplier with four quadrants with a differential input, as described in the reference [Gunhee Han and Edgar Sánchez-Sinencio, CMOS Transconductance Multipliers: A Tutorial. IEEE Trans. on Circ. and Syst., Vol. 45 No. 12, p 1550 (1998)], applied according to the circuit of FIG. 19.

By using a differential input and by using a register RegRef 32, it is possible to get rid of all of the offset problems, which may notably be related to a difference between the biases of the amplifiers 84 and 86 or to a charge transfer upon opening a transistor operating in a switch mode, to the operation of the follower circuit making up the registers of the memory 24.

The operating point of the differential input multiplier 34 is set by an adequate selection of that of the integrator 18, i.e. by adequately selecting the operating point at the input of the amplifier 86 which may itself depend on the selection of the power supply voltages of this amplifier. It should be noted that in the exemplary application of FIG. 19, the reference voltage is directly used at the input of a differential input multiplier 34, which is not the case in the document [Gunhee Han and Edgar Sánchez-Sinencio].

The output of the differential input multiplier 34 consists of two currents IP and IM, the difference IP-IM of which is the result of the multiplication. It should be noted that the potentials UP and UM at the output of the multiplier 34 should, when the multiplier 34 is operating, be identical and set to a specific value V0.

Figure 1:
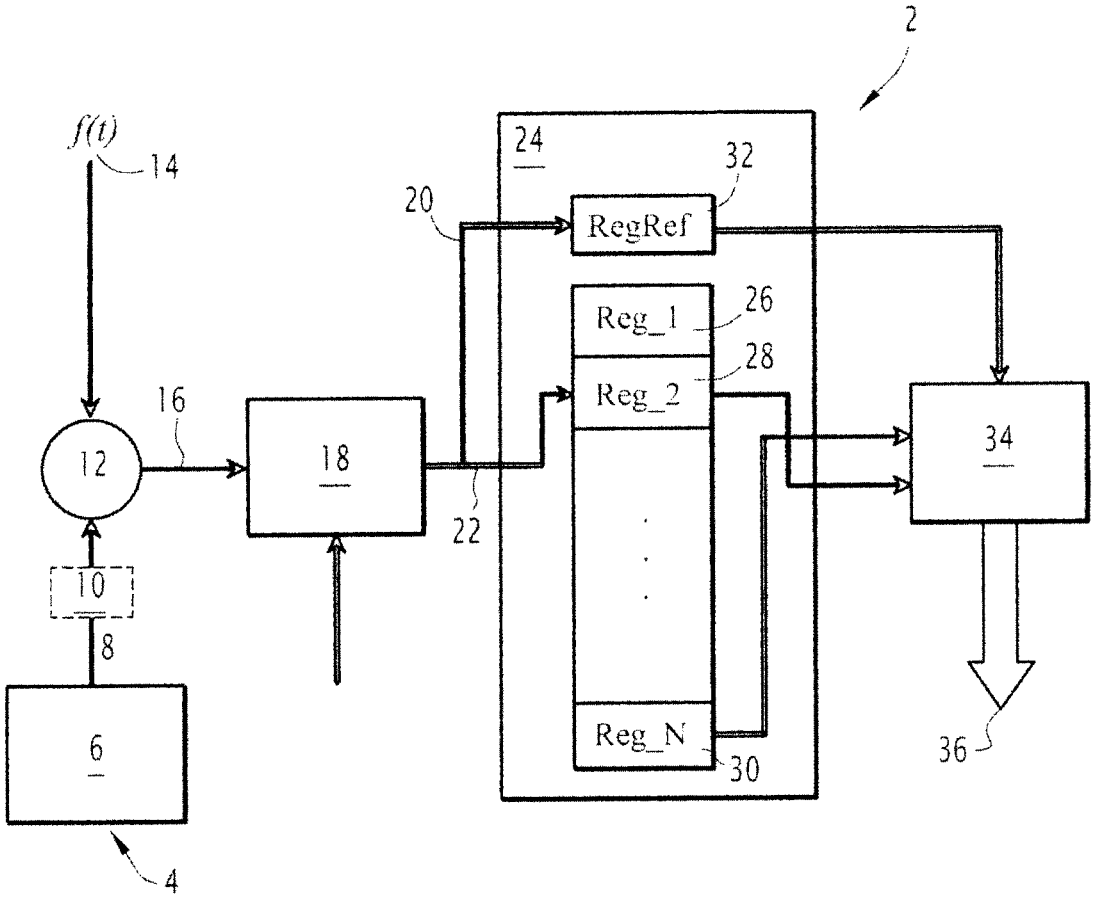
Figure 2:
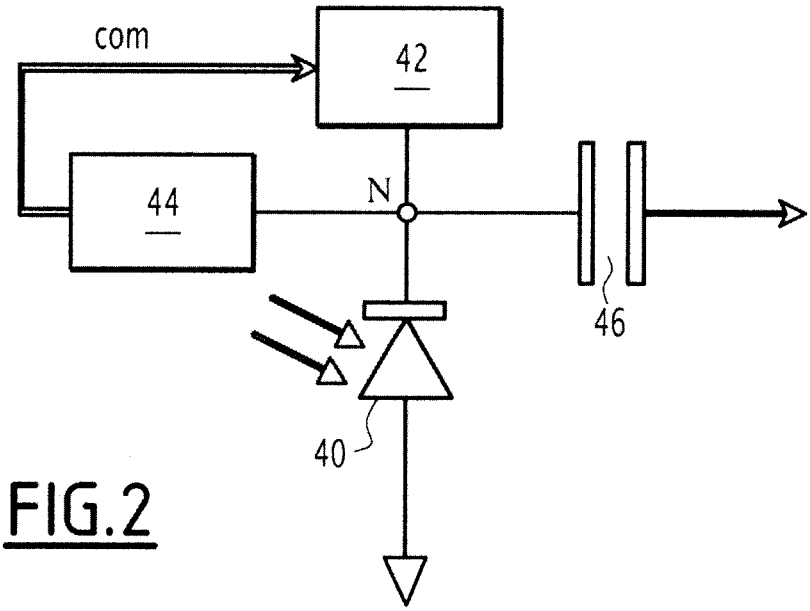
Figure 3:
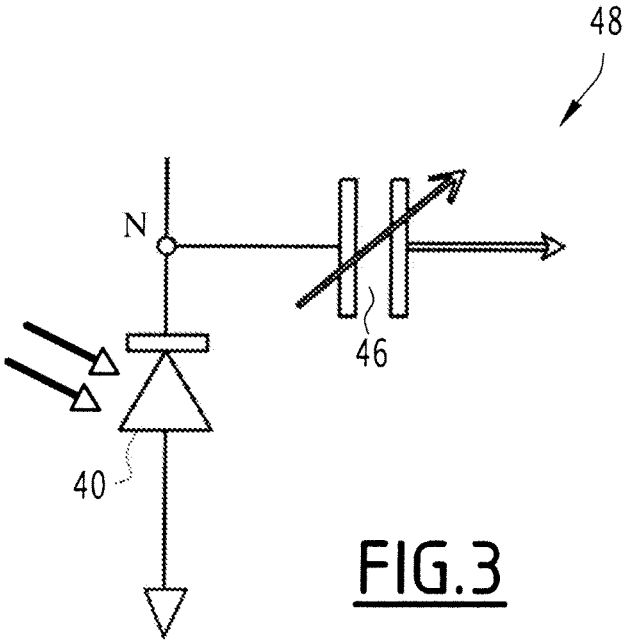
Figure 4:
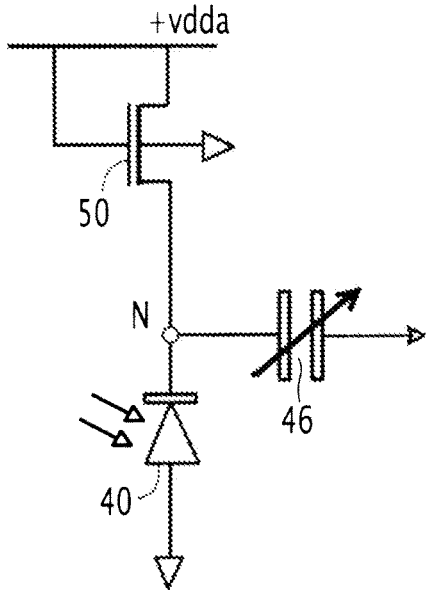
Figure 5:
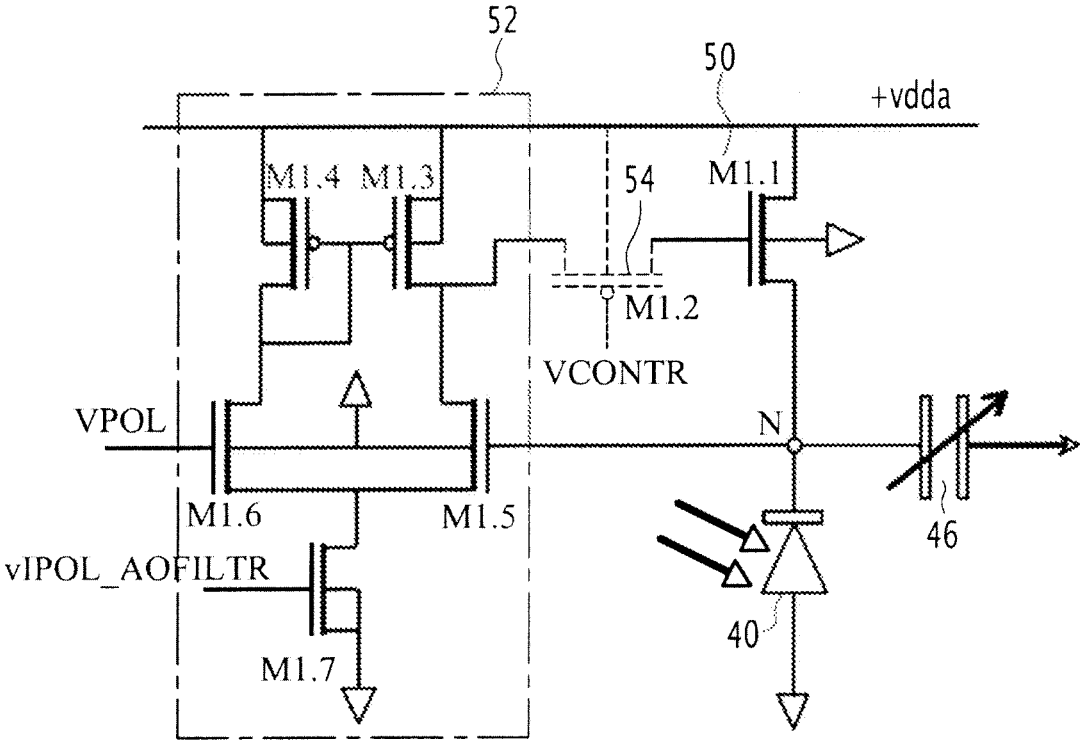

The output of the differential input multiplier 34 may advantageously be isolated from the remainder of the system, comprising a plurality of analog circuits according to the invention, by two switches M5.1 and M5.2 operating in a switch mode, and controlled by a binary memory 120 associated with the circuit of FIG. 1 and able to be addressed individually. When these switches are open, the differential input multiplier 34 no longer operates and the circuit of FIG. 1 is quite simply disconnected from the remainder of the system according to the invention.

The continuation of the description more particularly relates to the system for processing a light signal comprising a plurality of analog electronic circuits, according to the circuit of FIG. 1, connected together in a monolithic integrated circuit. Each of these individual circuits, integrated over 1 pixel, is called a base cell subsequently in the description.

The results of the different base cells may be simply added by connecting together the outputs P and M of each cell 2, and by using the node law. It is thus possible to obtain the sum SIP of the currents IP of a group of base cells, the sum SIM of the currents IM of the same group of cells, the difference SIP-SIM being the sum of the results of each cell of this group. This difference may be effected externally to the circuit, or internally, by using a current inverter 130. The inverter 130 according to the invention may either be used on one pixel or on a group of pixels, or on the totality of the pixels.

Figure 20:
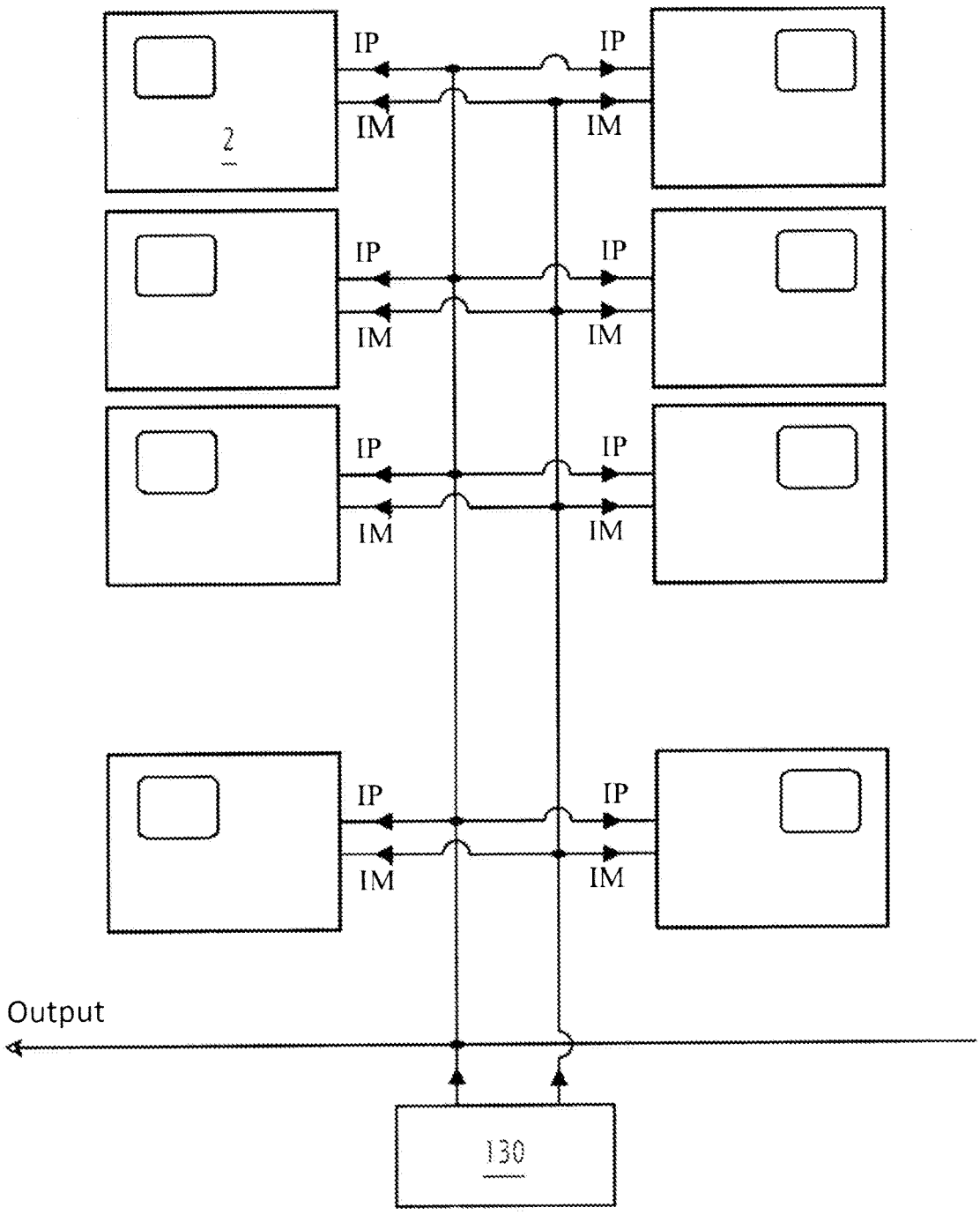

FIG. 20 shows an exemplary application of said inverter 130 on a column of base cells. The inverter 130 changes the sign of the current SIM, which is then added to the current SIP by the node law. The inverter 130 should guarantee that the outputs M of the base cells which are connected to it are properly biased at V0.

Figure 21:
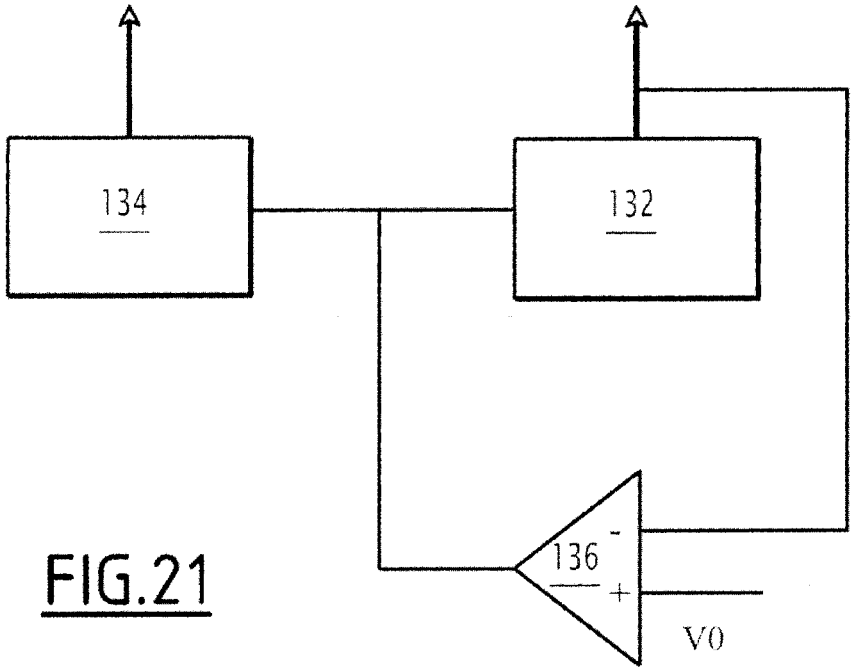

FIG. 21 shows a block diagram of this inverter 130, which operates according to the current mirror principle. It comprises two voltage-controlled identical current sources 132 and 134, one 132 of which allows compensation of the current for which the sign should be inverted, and the other one 134 of which provides the current with an inverted sign and a differential amplifier 136, the non-inverting terminal of which is connected to V0 and the inverting terminal is connected to the route bringing the current, the sign of which has to be inverted, and the output of which controls the current sources 132 and 134.

Figure 22:
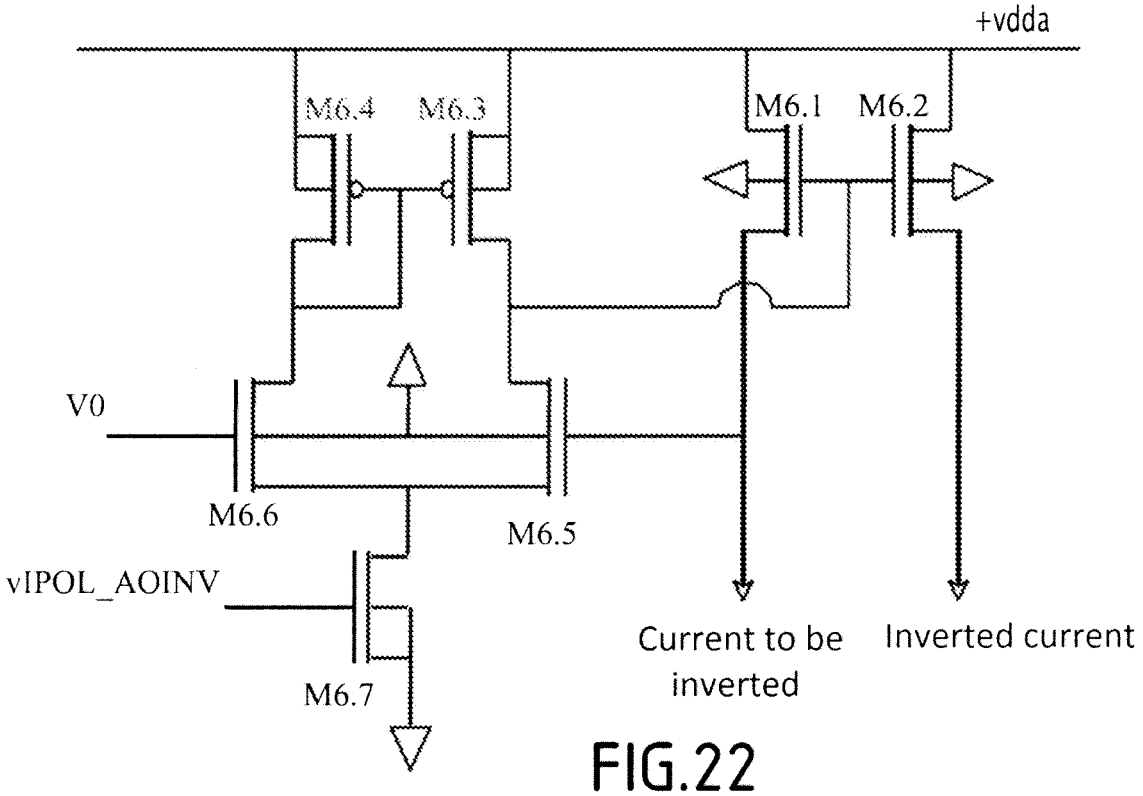

FIG. 22 shows an exemplary embodiment of said inverter 130, transistors M6.3 to M6.7 forming the differential amplifier 136 and transistors M6.1 and M6.2 forming the current sources 132 and 134.

Figure 23:
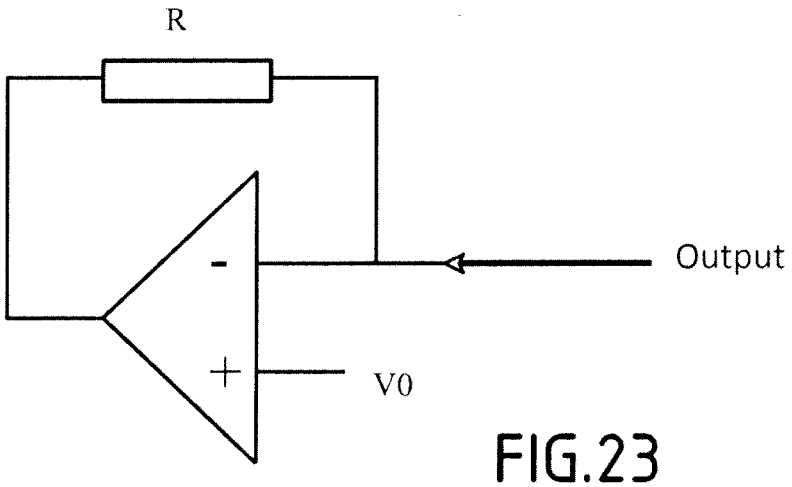

The final result is a current, proportional to the sum of the results from all the base cells which are connected to the system. This current may for example be read by the transimpedance circuit of FIG. 23, the only constraint being to make sure that this output route is properly biased at potential V0.

Figure 24:
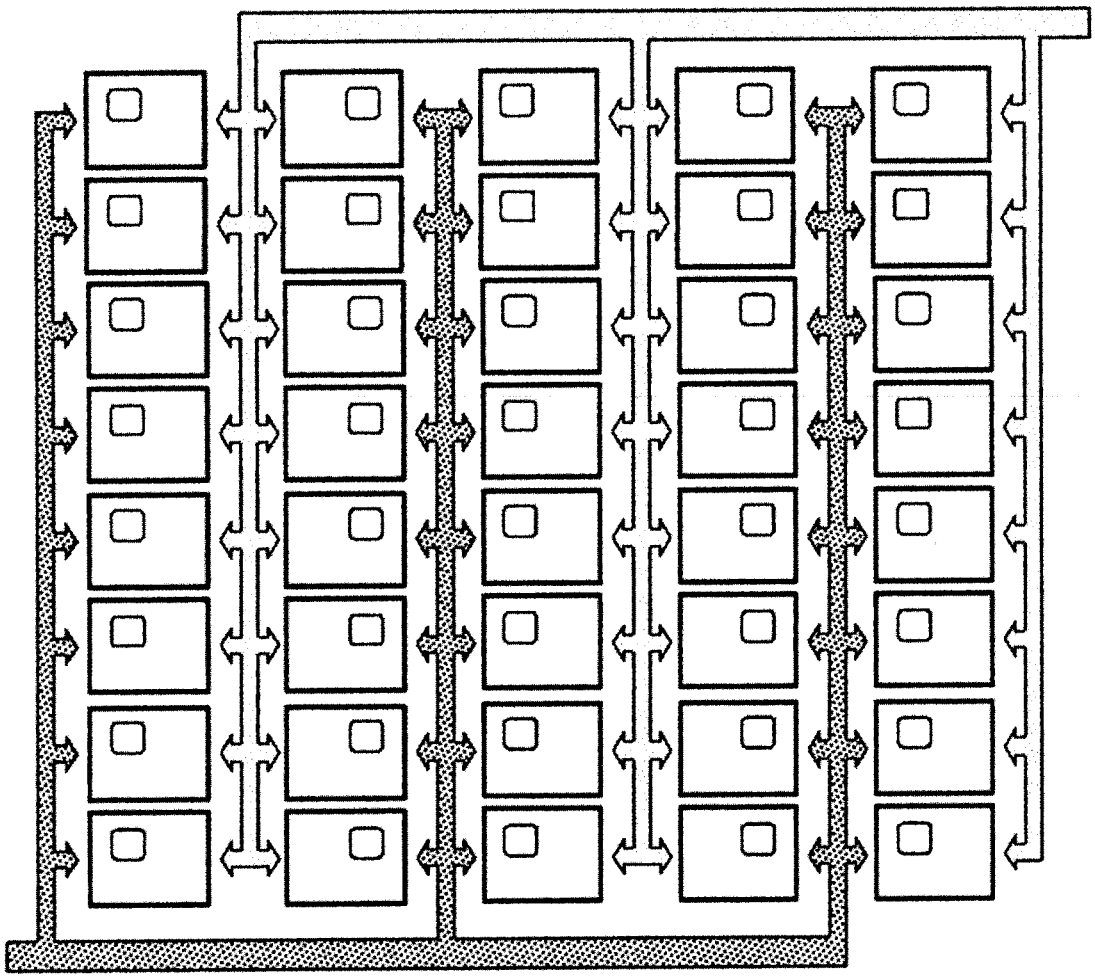

FIG. 24 shows a possible architecture of a circuit consisting of a matrix of base cells, as well as analog and digital buses for which the resources (including the currents SIM and SIP, which are included in the analog bus) are mutualized between the cells located on either side of said buses, by optionally applying symmetry to the cells.

Thus, the invention has the advantage of providing an analog circuit for processing a very weak light signal, while having a satisfactory signal-to-noise ratio by the integration of this circuit on a very small space with a size of less than or equal to 42×44 μm. It is thus possible to have a large number of pixels so as to maximize the signal-to-noise ratio.

It is thus possible, by this massively parallel processing, to process a large number of images per second (1000 to 100, 000) without using any particular fast electronics.

The originality of the circuit according to the invention essentially lies in the fact that it uses an analog memory, Now, the use of such an analog memory has difficulty as regards the suppression of offsets on the stored amount. This difficulty is solved in the circuit according to the invention, by using the reference register 32 and the differential input multiplier 34.

Further, the use of the multiplier 12 in the circuit according to the invention has many advantages as compared with the modulation of light beams, notably a simple principle, a maximum light intensity, low frequency parasitic noises having been suppressed. The selected technological solution is simple, original and may be integrated into a circuit of very small size. The reference register 32 allows suppression of the component related to the function $f_0(t)$, as well as all the offsets related to this device.

Figure 25:
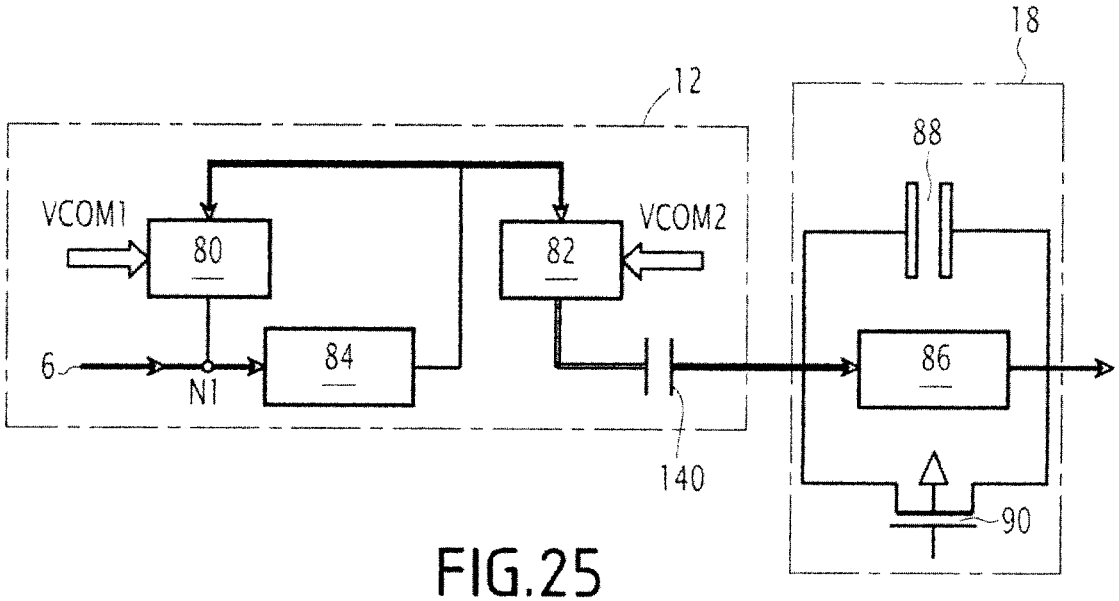

FIG. 25 illustrates a second embodiment of the multiplier 12 for which the elements similar to those of the first embodiment, described earlier with reference to FIG. 11, are marked with identical references and are therefore not described again.

According to the second embodiment, the multiplier 12 further comprises filtering means connected between the resistive device 82 and the inverting amplifier 86. In other words, the filtering means are positioned at the output of the resistive device 82. The filtering means for example include a capacitor 140 for filtering the signal at low frequencies, for example for frequencies of less than 200 kHz.

The demodulation stage comprises the filtering capacitor 140 connected between the resistive device 82 and the inverting amplifier 86, i.e. connected at the output of the resistive device 82.

The filtering capacitor 140 thus allows reduction or even suppression of the parasitic noise between the resistive device 82 and the inverting amplifier 86, for example corresponding to frequencies below 200 kHz of the current between the resistive device 82 and the inverting amplifier 86.

The operation of this second embodiment is similar to that of the first embodiment, and is therefore not described again.

The other advantages of this second embodiment are identical with those of the first embodiment, and are therefore not described again.

Figure 26:
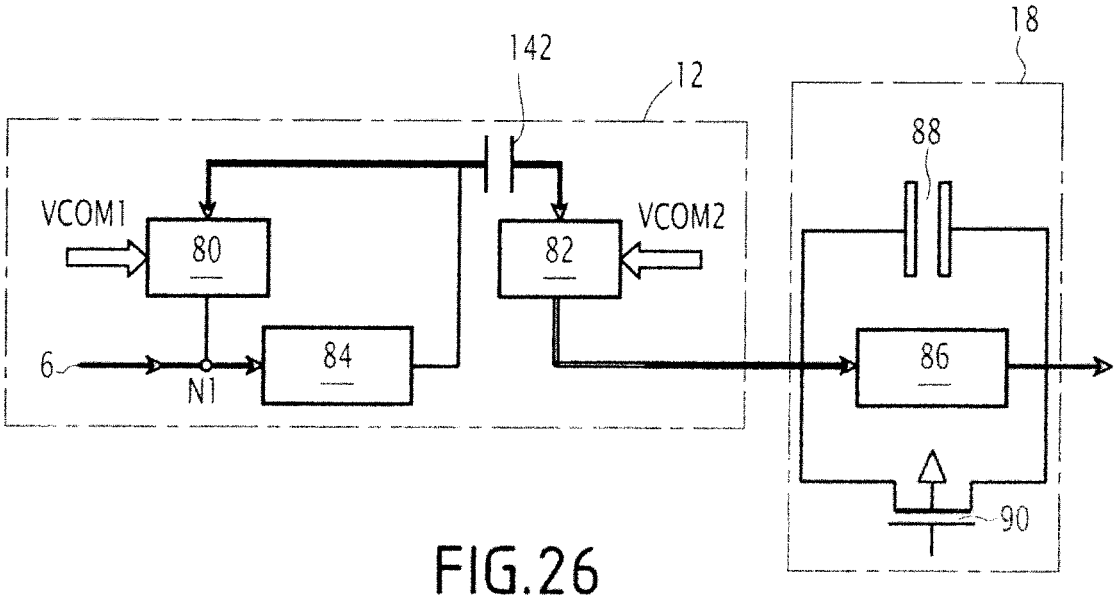

FIG. 26 illustrates a third embodiment of the multiplier 12 for which the elements similar to the those of the first embodiment, described earlier with reference to FIG. 11, are marked with identical references and are therefore not described again.

According to the third embodiment, the multiplier 12 comprises filtering means connected between the first inverting amplifier 84 and the resistive device 82. In other words, the filtering means are positioned at the input of the resistive device 82. The filtering means for example comprise a capacitor 142 for filtering noise at low frequencies, such as frequencies lower than 200 kHz.

The demodulation stage comprises the filtering capacitor 142 connected between the first inverting amplifier 84 and the resistive device 82, i.e. connected at the input of the resistive device 82.

The filtering capacitor 142 then allows reduction, or even suppression of the noise between the first inverting amplifier 84 and the resistive device 82, for example at frequencies below 200 kHz of the current flowing between the first inverting amplifier 84 and the resistive device 82.

The operation of this third embodiment is similar to the one of the first embodiment and is therefore not described again.

The other advantages of this third embodiment are identical with those of the first embodiment and are therefore not described again.

The invention claimed is:

1. An analog electronic circuit for processing a light signal, of the type comprising:

a photodetector adapted for producing an electric signal from a light signal;

a multiplier adapted for multiplying the electric signal with a reference signal in order to obtain a multiplied signal; and an integrator adapted for integrating the multiplied signal over at least one time interval, in order to obtain at least one integrated signal, the electronic circuit being characterized in that it further comprises:

an analog memory adapted for storing the integrated signal in memory; and a computing unit comprising a differential input multiplier and adapted for estimating a time correlation of the light signal from the integrated signal stored in memory.

2. The electronic circuit according to claim 1, characterized in that the memory comprises a plurality of data registers adapted for storing at least the integrated signal in memory and a reference register adapted for storing a reference voltage in memory.

3. The electronic circuit according to claim 1, characterized in that the electronic circuit comprises an amplifier for the electric signal produced by the photodetector.

4. The electronic circuit according to claim 1, characterized in that the photodetector includes a photodiode.

5. The electronic circuit according to claim 1, characterized in that the photodetector includes a high-pass filter.

6. The electronic circuit according to claim 1, characterized in that the electronic circuit is integrated into a pixel with a size of less than or equal to 42*44 μm.

7. A processing system for processing a light signal, characterized in that the processing system comprises a plurality of electronic circuits according to claim 1, connected together in an integrated circuit and means for summing time correlations obtained at the output of all the electronic circuits of the system.

8. The processing system according to claim 7, characterized in that the processing system comprises means for selectively disconnecting each of the electronic circuits of the system.

9. The electronic circuit of claim 1, wherein the multiplier and the integrator form an electronic demodulation comprising:

a voltage inverting amplifier receiving the electric signal as an input;

an integrator for which the operating point at the input corresponds to the operating point at the input of the voltage inverting amplifier, and first and second identical resistive devices, the conductance of which are voltage-controlled, the first resistive device connecting the output and the input of the voltage amplifier and the second resistive device connecting the output of the voltage inverting amplifier and the input of the integrator.

10. A method for processing a light signal comprising:

a step for producing an electric signal from the light signal;

a step for multiplying the electric signal with a reference signal in order to obtain a multiplied signal; and a step for integrating the multiplied signal over at least one time interval, in order to obtain at least one integrated signal, characterized in that it further comprises:

a step for storing in memory the integrated signal, in an analog memory; and a step for estimating, in a computing unit comprising a differential input multiplier, a time correlation of the light signal from the integrated signal stored in memory.

11. The processing method according to claim 10, characterized in that the reference signal is a signal of constant sign.

* * * * *